US010500626B2

(12) United States Patent
Nakamura et al.

(10) Patent No.: US 10,500,626 B2
(45) Date of Patent: Dec. 10, 2019

(54) MOLDED MATERIAL PRODUCTION METHOD AND MOLDED MATERIAL

(71) Applicant: Nisshin Steel Co. Ltd., Tokyo (JP)

(72) Inventors: Naofumi Nakamura, Tokyo (JP); Yudai Yamamoto, Tokyo (JP)

(73) Assignee: Nippon Steel Nisshin Co., Ltd., Tokyo (JP)

( * ) Notice: Subject to any disclaimer, the term of this patent is extended or adjusted under 35 U.S.C. 154(b) by 0 days.

(21) Appl. No.: 16/078,181

(22) PCT Filed: Feb. 21, 2017

(86) PCT No.: PCT/JP2017/006292
§ 371 (c)(1),
(2) Date: Aug. 21, 2018

(87) PCT Pub. No.: WO2017/146019
PCT Pub. Date: Aug. 31, 2017

(65) Prior Publication Data

US 2019/0047034 A1 Feb. 14, 2019

(30) Foreign Application Priority Data

Feb. 23, 2016 (JP) ..... 2016-032443

(51) Int. Cl.
*B21D 22/28* (2006.01)
*B21D 22/21* (2006.01)
*B21D 22/22* (2006.01)

(52) U.S. Cl.
CPC ..... *B21D 22/28* (2013.01); *B21D 22/21* (2013.01); *B21D 22/22* (2013.01)

(58) Field of Classification Search
CPC ..... B21D 22/28; B21D 22/21; B21D 22/22
(Continued)

(56) References Cited

U.S. PATENT DOCUMENTS

2008/0299352 A1* 12/2008 Matsuda ..... B21C 37/02 428/174
2015/0336152 A1 11/2015 Yamagata et al.
2017/0128998 A1 5/2017 Nakamura et al.

FOREIGN PATENT DOCUMENTS

CA 2951785 * 12/2015
JP 2013-051765 3/2013
(Continued)

OTHER PUBLICATIONS

English translation of the International Preliminary Report on Patentability, counterpart International Appl. No. PCT/JP2017/006292, dated Sep. 7, 2018 (6 pages).
(Continued)

*Primary Examiner* — David B Jones
(74) *Attorney, Agent, or Firm* — Cook Alex Ltd.

(57) ABSTRACT

Provided is a method for producing a molded material by molding processes including at least one drawing-out process and at least one drawing process performed after the drawing-out process, in which a width of a punch 31 used in the drawing-out process on a rear end side is wider than a width of the punch on a distal end side, and an ironing process is performed on a region corresponding to a flange of a base metal sheet 2 by pushing the base metal sheet together with the punch 31 into a pushing hole 30*a*, and the drawing process is carried out using a die and a drawing sleeve, and processing is performed on a region subjected to the ironing process in the drawing-out process, while maintaining a constant mold gap between the die and the drawing sleeve.

8 Claims, 10 Drawing Sheets

(58) Field of Classification Search
USPC ..... 72/353.2
See application file for complete search history.

(56) References Cited

FOREIGN PATENT DOCUMENTS

| | | |
|---|---|---|
| JP | 2016-002552 | 1/2016 |
| JP | 6305648 | 4/2018 |
| WO | WO 2014/109263 | 7/2014 |

OTHER PUBLICATIONS

Murakawa et al., Basics of Plastic Processing, First Edition, Sangyo-Tosho Publishing Co. Ltd., pp. 104-107, with English translation (Jan. 16, 1990) (12 pages).
International Search Report and Written Opinion, counterpart International App. No. PCT/JP2017/006292, with partial English translation (Apr. 11, 2017) (8 pages).
Notification of Reasons for Refusal, counterpart Japanese App. No. 2017-524059, with English translation (Dec. 28, 2017) (4 pages).
Decision to Grant a Patent, counterpart Japanese App. No. 2017-524059, with English translation (Feb. 14, 2018) (6 pages).

* cited by examiner

[FIG. 1]
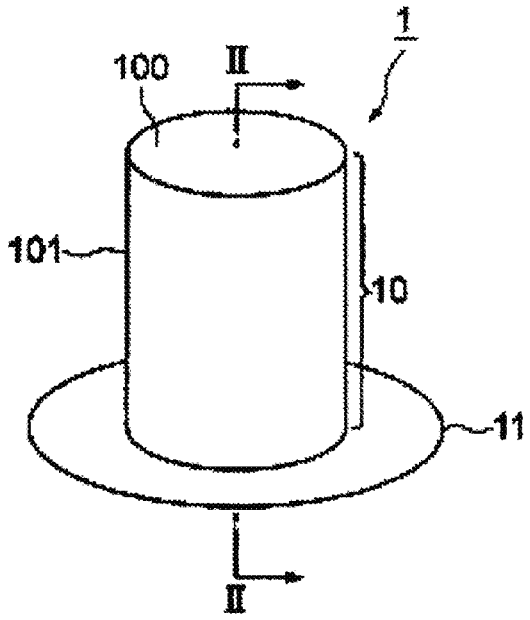

[FIG. 2]
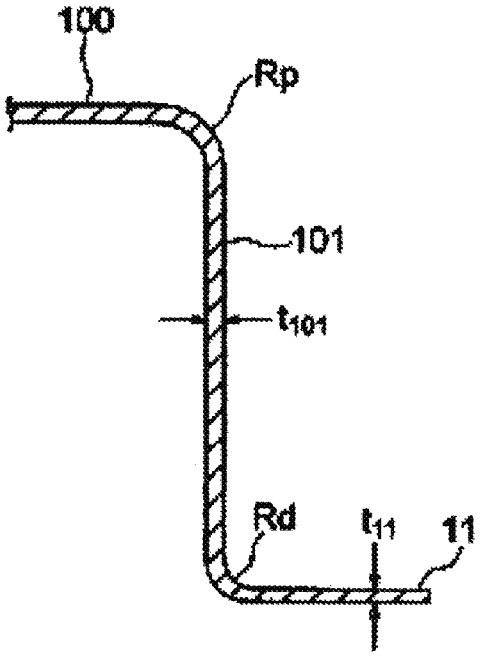

[FIG. 3]
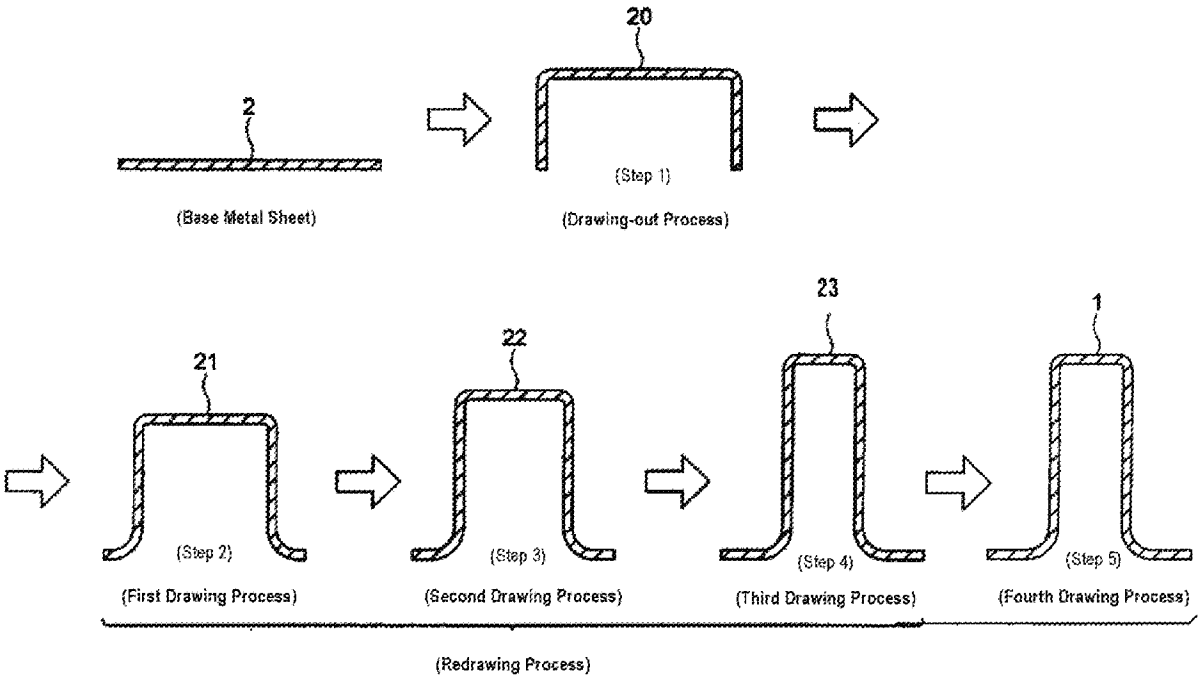

[FIG. 4]
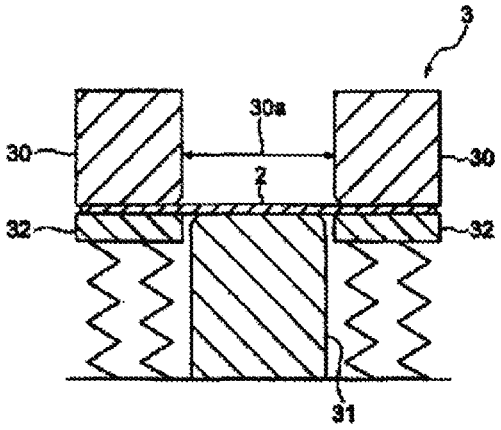

[FIG. 5]
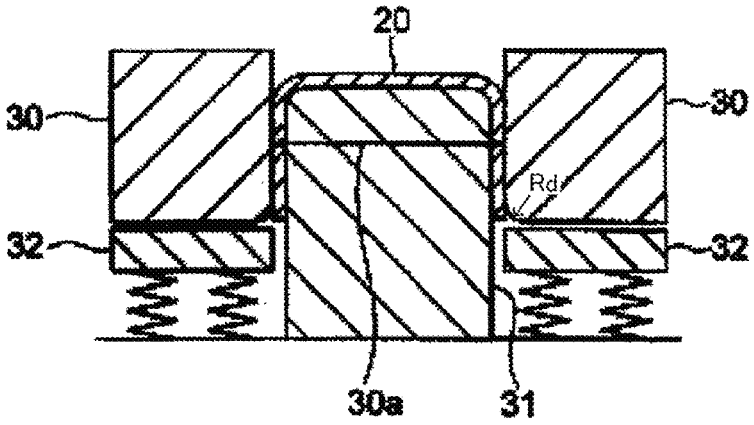

[FIG. 6]
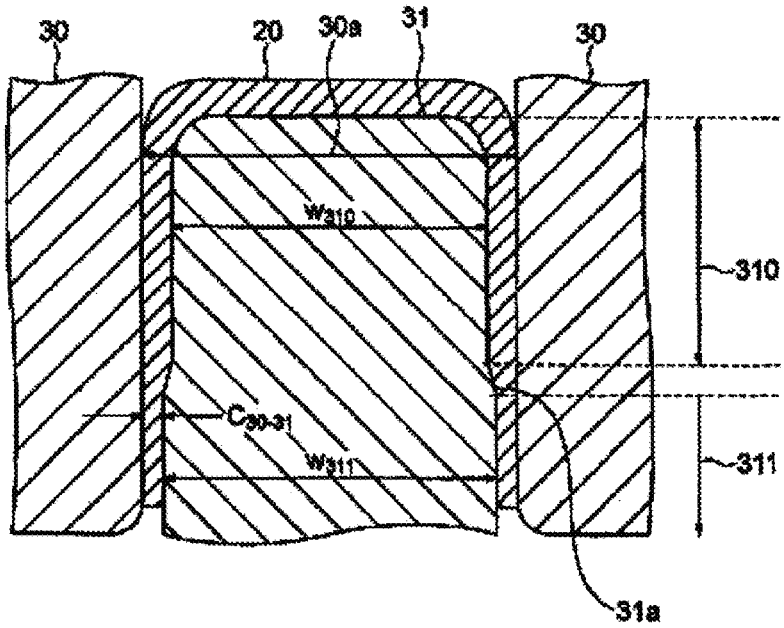

[FIG. 7]
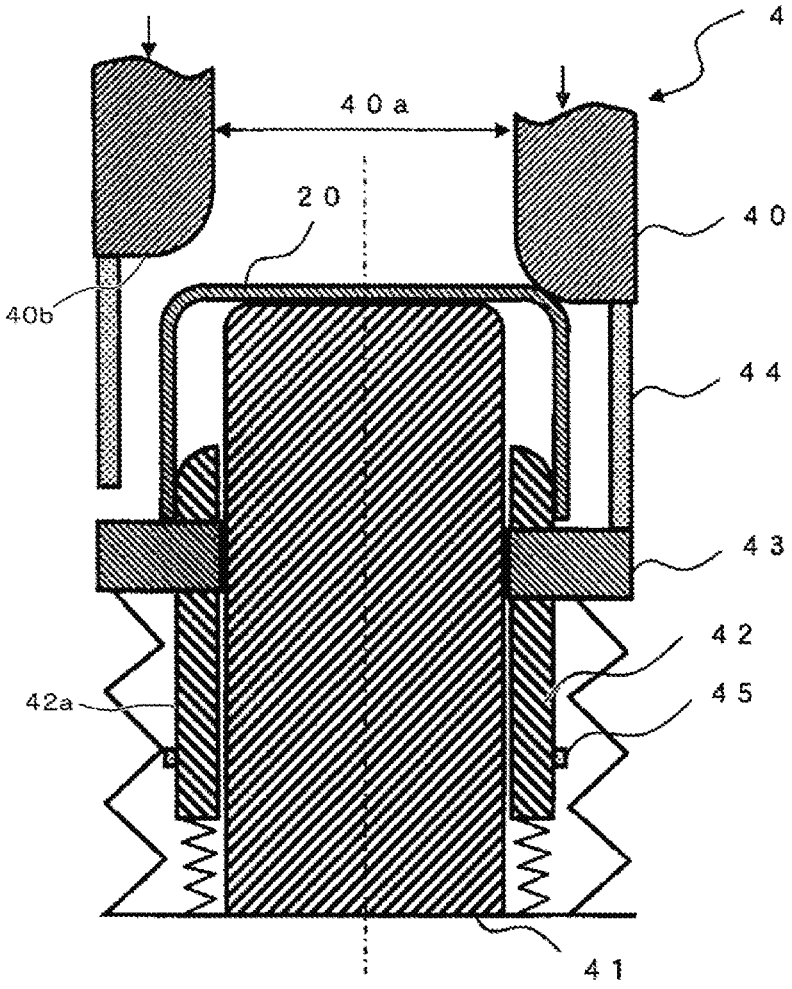

[FIG. 8]
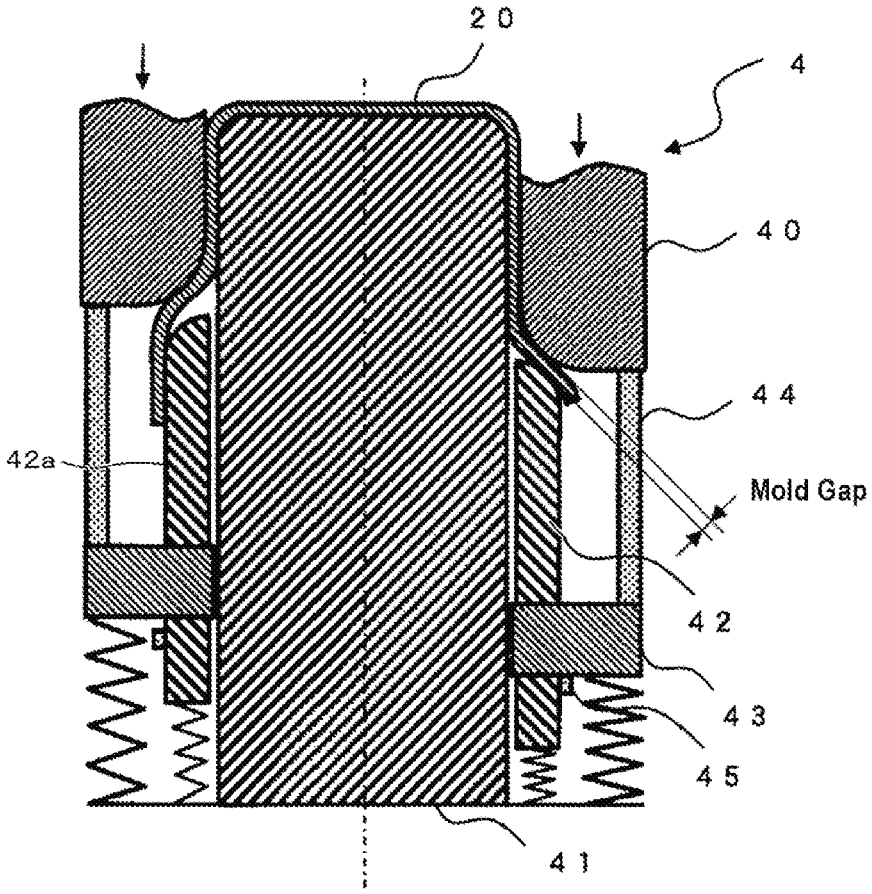

[FIG. 9]
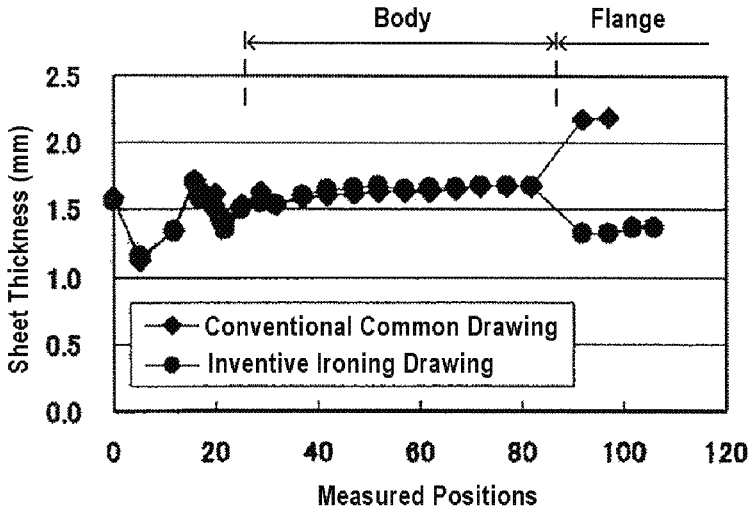

[FIG. 10]
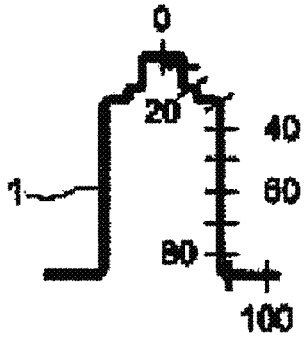

MOLDED MATERIAL PRODUCTION METHOD AND MOLDED MATERIAL

The present application is a U.S. National Stage of PCT international Patent Application No. PCT/JP2017/006292, filed Feb. 21, 2017, which claims priority to JP Application No, 2016-032443, filed Feb. 23, 2016, both of which are hereby incorporated herein by reference.

TECHNICAL FIELD

This invention relates to a method for producing a molded material including a tubular body and a flange formed at an end portion of the body, and also relates to a molded material.

BACKGROUND ART

As disclosed, for example, in non-patent document 1, a molded material including a tubular body and a flange formed at an end portion of the body is produced by performing a drawing process. The drawing process forms the body by drawing a base metal sheet, so that the thickness of the body is lower than that of the base sheet. On the other hand, a region of the metal sheet corresponding to the flange shrinks as a whole in response to the formation of the body, so that the thickness of the flange is higher than that of the base sheet. Hereinafter, the base material may be referred to as a "blank".

The molded material as described above may be used as a motor case disclosed, for example, in patent document 1 as described below. In this case, the body is expected to function as a shielding material for preventing magnetic leakage to the outside of the motor case. Depending on motor structures, the body is also expected to function as a back yoke of a stator. The performance of the body as the shield material or back yoke is improved as the thickness of the body increases. Therefore, when a molded material is produced by drawing, as described above, a base metal sheet with a thickness larger than the required thickness of the body is selected taking into account the reduction in thickness of the body caused by the drawing process. Meanwhile, the flange is often used for mounting the motor case on a mounting object. Therefore, the flange is expected to have a certain strength.

CITATION LIST

Patent Document

Patent Document 1: Japanese Patent Application Publication No. 2013-51765 A

Non-Patent Document

Non-patent Document 1: Masao Murakawa, et. al., "Basics of Plastic Processing", First Edition, SANGYO-TOSHO Publishing Co. Ltd., Jan. 16, 1990, pp. 104 to 107

SUMMARY OF INVENTION

Technical Problem

However, the conventional method for producing the molded material as described above produces the molded material including the tubular body and the flange formed at the end portion of the body by the drawing process, so that the thickness of the flange is larger than that of the base sheet. For this reason, the flange may become unnecessarily thicker over a thickness required for obtaining the expected performance of the flange. This means that the molded material becomes unnecessarily heavy, which cannot be ignored in applications in which weight reduction is required, such as motor cases.

On the other hand, in a multi-stage drawing process, when a change in diameter reduction of the flange before and after the drawing process is large, in other words, when a diameter of the flange after the drawing process becomes significantly smaller than the diameter of the flange before the drawing process, the lower thickness of the flange after the drawing process may generate wrinkles and/or buckling in the flange. The wrinkles and/or buckling may cause cracks during the subsequent drawing process.

In such a case, a drawing process using a drawing sleeve may be carried out in order to prevent the wrinkles and/or buckling. However, the drawing process is carried out by sandwiching the flange between a die and the drawing sleeve, so that a tensile stress will act on the body, causing a decrease in thickness of a circumferential wall of the body.

The present invention has been made to solve the above problems. An object of the present invention is to provide a method for producing a molded material and the molded material, which can avoid unnecessary thickening of the flange, reduce a weight of the molded material and achieve size reduction of the base metal sheet.

Solution to Problem

The present invention relates to a method for producing a molded material, the molded material comprising a tubular body and a flange formed at an end portion of the body, the molded material being produced by performing at least two molding processes on a base metal sheet, wherein the at least two molding processes comprise at least one drawing-out process and at least one drawing process performed after the drawing-out process; wherein the drawing-out process is carried out using a mold that comprises a punch and a die having a pushing hole; wherein a width of the punch on a rear end side is wider than a width of the punch on a distal end side so that when the punch is pushed into the pushing hole of the die, a clearance between the die and the punch is narrower on the rear end side than on the distal end side; and wherein an ironing process is performed on a region corresponding to the flange of the base metal sheet by pushing the base metal sheet together with the punch into the pushing hole in the drawing-out process.

In the method for producing the molded material, the drawing process is carried out using a mold comprising a die and a drawing sleeve, and in the drawing process, an ironing process is performed on a region corresponding to the flange of the base material sheet subjected to the ironing process in the drawing-out process, while maintaining a constant mold gap between the die and the drawing sleeve.

Further, the drawing process performed at the constant mold gap between the die and the drawing sleeve is preferably carried out such that the mold gap is 1.0 times or more and 1.35 times or less an average thickness of the flange before the drawing process. Alternatively, the drawing process is carried out using a mold comprising a die, a drawing sleeve and a punch, and the drawing process that does not reduce a diameter of the flange is preferably carried out while opening the mold gap between the die and the drawing sleeve, and the drawing process that reduces a diameter of the flange is preferably carried out such that the mold gap between the die and the drawing sleeve is 1.0 times or more and 1.35 times or less an average thickness of the flange before the drawing process.

Further, the present invention relates to a molded material which comprises a tubular body and a flange formed at an end portion of the body, and is produced by carrying out at least two molding processes on a base metal sheet, wherein the at least two molding processes comprise at least one drawing-out process and at least one drawing process performed after the drawing-out process; wherein in the drawing-out process, an ironing process is performed on a region corresponding to the flange of the base metal sheet; and wherein in the drawing process, an ironing process is also performed on only a region corresponding to the flange, whereby the thickness of the flange is lower than that of a circumferential wall of the body.

Furthermore, the present invention relates to a molded material which comprises a tubular body and a flange formed at an end portion of the body and is produced by carrying out at least two molding processes on a base metal sheet, wherein the at least two molding processes comprise at least one drawing-out process and at least one drawing process performed after the drawing-out process; wherein in the drawing-out process, an ironing process is performed on a region corresponding to the flange of the base metal sheet; and wherein in the drawing process, an ironing process is also performed on only a region corresponding to the flange, whereby the thickness of the flange is lower than that of the base metal sheet.

Advantageous Effects of Invention

According to the method for producing the molded material and the molded material according to the present invention, the drawing-out process involves the ironing process performed on the region corresponding to the flange of the base metal sheet by pushing the base metal sheet together with the punch into the pushing hole, and during the drawing process, only the region corresponding to the flange of the base metal sheet subjected to the ironing process in the drawing-out process is subjected to the ironing process and molded while sandwiching the region between the die and the drawing sleeve. Therefore, generation of wrinkles and buckling in the flange can be prevented, and breakage can be avoided. Further, an unnecessary increase in the thickness of the flange can be avoided so that the weight of the molded material can be reduced. This configuration is particularly useful for various applications in which weight reduction is required, such as motor cases.

BRIEF DESCRIPTION OF DRAWINGS

FIG. 1 is a perspective view showing a molded material produced by a method for producing a molded material according to Embodiment 1 of the present invention.

FIG. 2 is a sectional view taken along the line II-II in FIG. 1.

FIG. 3 is an explanatory view illustrating a method for producing the molded material shown in FIG. 1.

FIG. 4 is an explanatory view illustrating a mold used in the drawing-out process shown in FIG. 3.

FIG. 5 is an explanatory view illustrating the drawing-out process performed with the mold shown in FIG. 4.

FIG. 6 is an explanatory view illustrating the punch shown in FIG. 4, in more detail.

FIG. 7 is an explanatory view illustrating the mold used in a first drawing process show in FIG. 3.

FIG. 8 is an explanatory view illustrating a first drawing process performed with the mold shown in FIG. 7.

FIG. 9 is a graph showing a thickness distribution of a molded material produced by a method for producing a molded material according to the present embodiment.

FIG. 10 is an explanatory view showing the sheet thickness measured positions in FIG. 9.

DESCRIPTION OF THE PREFERRED EMBODIMENTS

Embodiments of the present invention will be described below with reference to the drawings.

Embodiment 1

FIG. 1 is a perspective view showing a molded material 1 produced by a method for producing a mold material according to Embodiment 1 of the present invention. As shown in FIG. 1, the molded material 1 produced by the method for producing the molded material according to the present embodiment includes a body 10 and a flange 11. The body 10 is a tubular portion having a top wall 100 and a circumferential wall 101 that extends from an outer edge of the top wall 100. Depending on the orientation of the molded material 1 to be used, the top wall 100 may be referred to by other terms, such as a bottom wall. In FIG. 1, the body 10 is shown to have a perfectly circular sectional shape, but the body 10 may have another shape, for example, such as an elliptical sectional shape or angular tubular shape. The top wall 100 may be subjected to further processing. For example, a protrusion further projecting from the top wall 100 can be formed. The flange 11 is a sheet portion formed on an end portion (an end of the circumferential wall 101) of the body 10.

FIG. 2 is a sectional view taken along the line II-II in FIG. 1. As shown in FIG. 2, a sheet thickness $t_{11}$ of the flange 11 is lower than a sheet thickness $t_{101}$ of the circumferential wall 101 of the body 10. The reason for this is that the ironing process is performed on a region of corresponding to the flange 11 of a base metal sheet 2 (see FIG. 3), as will be described in detail below. As used herein, the sheet thickness $t_{11}$ of the flange 11 means an average value of the sheet thickness of the flange 11 from a lower end of a lower side shoulder portion Rd between the circumferential wall 101 and the flange 11 to an outer end of the flange 11. Similarly, the sheet thickness $t_{101}$ of the circumferential wall 101 means an average value of the sheet thickness of the circumferential wall 101 from an upper end of the lower side shoulder portion Rd to a lower end of an upper side shoulder portion Rp.

FIG. 3 is an explanatory view illustrating the method for producing the molded material 1 shown in FIG. 1. The method for producing the molded material according to the present invention produces the molded material 1 by performing at least two molding processes on a flat base metal sheet 2. The at least two molding processes include at least one drawing-out process and at least one drawing process performed after the drawing-out process. In the method for producing the molded material according to this embodiment, the molded material 1 is produced by one drawing-out process and four redrawing processes (first to fourth drawing processes).

FIG. 4 is an explanatory view illustrating a mold 3 used in the drawing-out process shown in FIG. 3, and FIG. 5 is an explanatory view illustrating the drawing-out process performed with the mold 3 shown in FIG. 4. As shown in FIG. 4, the mold 3 used in the drawing-out process includes a die 30; a punch 31; and a cushion pad 32. The die 30 is provided with a pushing hole 30*a* into which the base metal sheet 2 is pushed together with the punch 31. The cushion pad 32 is disposed at an outer peripheral position of the punch 31 so as to face an outer end surface of the die 30. As shown in FIG. 5, in the drawing-out process, an outer edge portion of the base metal sheet 2 is not completely constrained by the die 30 and the cushion pad 32, and the outer edge portion of the base metal sheet 2 is drawn out until it escapes from the constraint applied thereto by the die 30 and the cushion pad 32. The entire base metal sheet 2 may be pushed together with the punch 31 into the pushing hole 30*a* and drawn out.

FIG. 6 is an explanatory view illustrating the punch 31 shown in FIG. 4, in more detail. As shown in FIG. 6, a width $w_{311}$ of a rear end side 311 of the punch 31 used in the drawing-out process is wider than a width $w_{310}$ of a distal end side 310 of the punch 31. Meanwhile a width of the pushing hole 30*a* is substantially uniform along an insertion direction in which the punch 31 is inserted into the pushing hole 30*a*. In other words, an inner wall of the die 30 extends substantially parallel to the insertion direction of the punch 31.

Thus, as shown in FIG. 6, a clearance $C_{30\text{-}31}$ between the die 30 and the punch 31 in a state where the punch 31 has been pushed into the pushing hole 30*a* is narrower on the rear end side 311 of the punch 31 than on the distal end side 310 of the punch 31. The clearance $C_{30\text{-}31}$ on the rear end side 311 of the punch 31 is set to be narrower than the sheet thickness of the base metal sheet 2 before the drawing-out process is performed. This allows the base metal sheet 2 to be pushed together with the punch 31 into the pushing hole 30*a* in the drawing-out process, so that the ironing process is performed on the outer edge portion of the base metal sheet 2, that is, on a region corresponding to the flange 11. The ironing process reduces the sheet thickness of the region corresponding to the flange 11 (decreases the thickness).

It should be noted that between the distal end side 310 and the rear end side 311 of the punch 31 is provided a width variation portion 31*a* comprised of an inclined surface that continuously changes a width of the punch 31. The width variation portion 31*a* is disposed so as to be in contact with a region of the base metal sheet 2 corresponding to the lower side shoulder portion Rd (see FIG. 2) between the width variation portion 31*a* and the inner wall of the die 30 when the base metal sheet 2 is pushed together with the punch 31 into the pushing hole 30*a* in the drawing-out process.

Next, FIG. 7 is an explanatory view illustrating a mold 4 used in the first drawing process in FIG. 3, and FIG. 8 is an explanatory drawing showing the first drawing by means of the mold 4 in FIG. 7. With reference to FIGS. 7 and 8, the movement of the mold and the state of processing during the first drawing process will be described in detail.

As shown in FIG. 7, the mold 4 used in the first drawing process includes a die 40; a punch 41; a drawing sleeve 42; a lifter plate 43; a killer pin 44; and a stopper 45. The die 40 is provided with a pushing hole 40*a* into which a first intermediate body 20 formed by the above drawing-out process is pushed together with the punch 41. The drawing sleeve 42 is disposed at an outer peripheral position of the punch 41 so as to face an outer end surface 40*b* of the die 40.

The left half of FIG. 7 shows a state where the first intermediate body 20 is placed on an upper surface of the lifter plate 43 and an inner peripheral surface of the first intermediate body 20 is in contact with an outer peripheral surface 42*a* of the drawing sleeve 42. At this time, although the die 40 begins to descend, the outer end surface 40*b* of the die 40 is not in contact with the first intermediate body 20, so that the drawing process of the first intermediate body 20 is not started yet. The tip of the killer pin 44 provided on the outer end surface 40*b* of the die 40 does not reach the upper surface of the lifter plate 43.

The right half of FIG. 7 shows a state where the die 40 has further descended to be in contact with the first intermediate body 20, and the drawing process has been started. At this time, the tip of the killer pin 44 reaches the upper surface of the lifter plate 43, so that the die 40 descends and the killer pin 44 pushes down the lifter plate 43. This allows maintenance of the state where the lower end of the body of the first intermediate body 20 is not in contact with the upper surface of the lifter plate 43. That is, the killer pin 44 is longer than the height of the circumferential wall of the first intermediate body 20.

Next, the left half of FIG. 8 shows a state where the die 40 continues to further descend and the first intermediate body 20 is pushed into the pushing hole 40*a* of the die 40, that is, a state where the drawing process is carried out on the body of the first intermediate body 20. Also at this time, the tip of the killer pin 44 reaches the upper surface of the lifter plate 43, and the killer pin 44 pushes down the lifter plate 43 as the die 40 descends. Therefore, when undergoing the drawing process, the lower end of the body of the first intermediate body 20 is not in contact with the upper surface of the lifter plate 43 and is in an uplifting state. Since the lower end of the body is uplifting from the upper surface of the lifter plate 43, any compressive stress in the upward direction is not applied to the circumferential wall of the body.

Further, a space between the die 40 and the drawing sleeve 42 is open, and the lower portion of the body of the first intermediate body 20 (a region corresponding to the flange 11 in FIG. 2) is not sandwiched by the die 40 and the drawing sleeve 42.

In the state shown in the left half of FIG. 8, the inner side of the lower portion of the body of the first intermediate body 20 is in contact with the outer peripheral surface 42*a* of the drawing sleeve 42. In such a state, the radius of the lower end of the body of the first intermediate body 20 does not change even if the drawing process progresses to the body of the first intermediate body 20. In this case, since the lower end of the body of the first intermediate body 20 is not sandwiched by the die 40 and the drawing sleeve 42 as described above, it is possible to suppress a decrease in the sheet thickness of the circumferential wall of the body.

The right half of FIG. 8 shows a state where the die 40 further continue to descent, so that the lower surface of the lifter plate 43 is brought into contact with the stopper 45 provided on the outer peripheral surface 42*a* of the drawing sleeve 42. The lower surface of the lifter plate 43 is brought into contact with the stopper 45, whereby the drawing sleeve 42 will descend in synchronization with the die 40. This leads to a constant mold gap between the die 40 and the drawing sleeve 42.

In the state shown in the right half of FIG. 8, the lower portion of the body of the first intermediate body 20 is located above the outer peripheral surface 42*a* of the drawing sleeve 42. Therefore, as the drawing process of the body of the first intermediate body 20 progresses, the radius of the lower end of the body of the first intermediate body 20 gradually decreases, and the sheet thickness of the lower portion of the body begins to gradually increase. The mold gap between the die 40 and the drawing sleeve 42 after the lower surface of the lifter plate 43 is brought into contact with the stopper 45 is set to be narrower than the sheet thickness of the lower portion of the body of the first intermediate body 20, which thickness has been increased with the progress of the drawing process. By setting the mold gap in such a way, an ironing process can be performed on the lower portion of the body of the first intermediate body 20. The ironing process can decrease an amount of reducing the radius of the lower end of the body of the first intermediate body 20. Further, the ironing process can allow prevention of wrinkles and buckling. As will be described below, the mold gap between the die 40 and the drawing sleeve 42 during the ironing process is preferably 1.0 times or more and 1.35 times or less an average sheet thickness of the lower portion of the body of the first intermediate body 20 before the first drawing process is performed.

The second and third drawing processes shown in FIG. 3 can be carried out using a conventional mold (not shown). In the second drawing process, the drawing process is further performed on a region of a second intermediate body 21 (see FIG. 3) formed in the first drawing process, the region corresponding to the body 10. The third drawing process corresponds to a re-striking process, in which the ironing process is performed on a region of a third intermediate body 22 (see FIG. 3) formed in the second drawing process, the region corresponding to the body 10.

In the first to third drawing processes, shrinkage occurs in the region corresponding to the flange 11 in FIG. 2, and an increase in the thickness occurs in this region. However, by sufficiently reducing the sheet thickness of the region corresponding to the flange 11 in the drawing-out process, the sheet thickness $t_{11}$ of the flange 11 can be decreased as compared with the sheet thickness $t_{101}$ of the circumferential wall 101 of the body 10, in the final molded material 1. An amount of reducing the sheet thickness of the region corresponding to the flange 11 in the drawing-out process can be adjusted, as needed, by changing the clearance $C_{30\text{-}31}$ on the rear end side 311 of the punch 31 of the mold 3 used in the drawing-out process.

EXAMPLES

Next, Examples will be described. The present inventors prepared a round sheet having a thickness of 1.8 mm and a diameter of 116 mm and formed by conducting Zn—Al—Mg alloy plating on a common cold-rolled steel sheet, as the base metal sheet 2. The drawing-out process was then carried out under the following processing conditions. Here, the Zn—Al—Mg alloy plating was applied onto both surface of the cold-rolled steel sheet, and a plating coverage was 90 g/m$^2$ for each surface.

- Ironing ratio of region corresponding to flange 11: −20% to 60%;
- Curvature radius Rd of mold 3: 6 mm;
- Diameter of pushing hole 30*a*: 70 mm;
- Diameter of distal end side 310 of punch 31: 65.7 mm;
- Diameter of rear end side 311 of punch 31: 65.7 mm to 68.6 mm;
- Shape of width variation portion 31*a*: inclined surface or right angle step;
- Position of width variation portion 31*a*: region corresponding to lower side shoulder portion Rd, region corresponding to flange 11 or region corresponding to body 10;
- Press oil: TN-20; and
- Material of die and punch: SKD 11 (HRC hardness: 60).

<Evaluation of Ironing Ratio>

When the ironing ratio was 30% or less (when the diameter of the rear end side 311 of the punch 31 was 67.5 mm or less), the processing could be performed without any problem. However, when the ironing ratio was greater than 30% and equal to or less than 50% (when the diameter of the rear end side 311 of the punch 31 was greater than 67.5 mm and equal to or less than 68.2 mm), a slight scratching mark was found at a portion sliding against the die 30. Further, when the ironing ratio exceeded 50% (when the diameter of the rear end side 311 of the punch 31 was greater than 68.2 mm), seizure and cracking occurred against the inner wall of the die 30. Therefore, these results demonstrate that the ironing ratio of the region corresponding to the flange 11 in the drawing-out process is preferably equal to or less than 50%, and more preferably equal to or less than 30%. However, the scratching is not a significant problem because it can be improved by subjecting the die or punch to a ceramic coating treatment or the like.

<Ironing Ratio>

The ironing ratio is as represented by the following equation:

$$\text{Ironing Ratio (\%)} = \frac{\text{Sheet thickness before ironing} - \text{Sheet thickness after ironing}}{\text{Sheet thickness before ironing}} \times 100$$

Here, a value of the sheet thickness of the base metal sheet can be used as the sheet thickness before ironing.

<Evaluation of Shape of Width Variation Portion 31*a*>

As shown in FIG. 6, when the width variation portion 31*a* was formed with the inclined surface, the processing could be performed without any problem. However, when the width variation portion 31*a* was formed with the right angle step, that is, when the front end side 310 and the rear end side 311 of the punch 31 are formed with one step difference, plating residue was generated at a portion that was in contact with the right angle step. These results demonstrate that it is preferable to form the width variation portion 31*a* with the inclined surface.

<Evaluation of Position of Width Variation Portion 31*a*>

When the width variation portion 31*a* was provided so as to be in contact with the region corresponding to the lower side shoulder portion Rd, the ironing process of the region corresponding to the flange 11 could be satisfactorily performed. However, when the width variation portion 31*a* was provided so as to be in contact with the region corresponding to the flange 11, the thickness of a part of the flange portion 11 could not be sufficiently decreased. Further, when the width variation portion 31*a* was provided so as to be in contact with the region corresponding to the body 10, a part of the body 10 became thinner than the target sheet thickness. These results demonstrate that it is preferable to provide the width variation portion 31*a* so as to be in contact with the region corresponding to the lower side shoulder portion Rd.

It should be noted that the position of the width variation portion 31*a* is determined by performing the molding to the molded material which has completed the redrawing process in advance after determining mold conditions for mass production, and then counting backward from the position corresponding to the lower side shoulder portion Rd.

In Examples, hereinafter, the lower end of the body of the first intermediate body is referred to as a flange.

<Effect of Presence and Absence of Drawing Sleeve>

Table 1 shows a relationship between an average sheet thickness of the flange before the drawing process and a diameter of the flange before and after the drawing process, on the generation of wrinkles and/or buckling when the drawing sleeve is not used. The symbol $t_0$ is a sheet thickness of the base metal plate, and the symbol $t_1$ is an average sheet thickness of the flange before the drawing process, that is, an average sheet thickness of the region corresponding to the flange after the drawing-out process. The symbol $D_{(n-1)}$ is a diameter of the flange after the $n-1^{th}$ drawing process, and the symbol $D_n$ is a diameter of the flange after the $n^{th}$ drawing process. The wrinkles and/or buckling were generated under conditions of $t_1<t_0$ and $D_n<0.93\times D_{(n-1)}$, that is, conditions where the average sheet thickness $t_1$ of the flange before the drawing process is thinner than the sheet thickness to of the base metal sheet ($t_1<t_0$) and the diameter of the flange $D_n$ after the $n^{th}$ drawing process is significantly smaller than the diameter of the flange $D_{(n-1)}$ after the $n-1^{th}$ drawing process ($D_n<0.93\times D_{(n-1)}$).

TABLE 1

| | $t_1 > t_0$ | $t_1 = t_0$ | $t_1 < t_0$ |
|---|---|---|---|
| $D_n > D_{(n-1)}$ | Good | Good | Good |
| $D_n = 0.98 \times D_{(n-1)}$ | Good | Good | Slight Wrinkles |
| $D_n < 0.93 \times D_{(n-1)}$ | Good | Good | Wrinkles and Buckling |

Sheet Thickness of Base Material: $t_0$,
Sheet Thickness of Flange before Drawing Process: $t_1$
Diameter of Flange after $n-1^{th}$ Drawing Process: $D_{n-1}$
Diameter of Flange after $n^{th}$ drawing process: $D_n$ The results in the case of using the drawing sleeve are shown in Table 2. In this case, the diameter of the flange is not changed when performing the drawing process on the body. Therefore, in this case, a space between the die 40 and the drawing sleeve 42 was opened such that the outer edge portion was not sandwiched, thereby suppressing a decrease in the sheet thickness of the circumferential wall of the body. Further, when the ironing process is performed on the region where the sheet thickness has been decreased by carrying out the ironing process in the step of the drawing-out process, the diameter of the flange is reduced. In this case, the mold gap (clearance) between the die 40 and the drawing sleeve 42 was set to be constant at various values.

TABLE 2

| Mold Gap (Clearance) | Evaluation |
|---|---|
| Flange Average Sheet Thickness × 1.5 | Wrinkles and Buckling |
| Flange Average Sheet Thickness × 1.35 | good |
| Flange Average Sheet Thickness × 1.2 | good |
| Flange Average Sheet Thickness × 1.0 | good |

Here, for the region where the ironing process was performed to decrease the sheet thickness, the mold gap was made constant at the timing when contraction processing began.

Further, it was carried out under the condition where the diameter of the flange after the $n^{th}$ drawing process was significantly smaller than the diameter of the flange after the $(n-1)^{th}$ drawing process ($D_n<0.93\times D_{(n-1)}$).

The mold gap (clearance) was set to various values under the above condition that the flange diameter $D_n$ after the $n^{th}$ drawing process was significantly smaller than the flange diameter $D_{(n-1)}$ after the $n-1^{th}$ drawing process, and the drawing process was carried out. As shown in Table 2, no winkle or buckling was generated when the mold gap (clearance) was 1.0 times or more and 1.35 times or less the average sheet thickness of the flange before the drawing process.

<Sheet Thickness of Flange>

Next, FIG. 9 is a graph showing the sheet thickness distribution of the molded material produced from the first intermediate body. FIG. 10 is an explanatory view showing the sheet thickness measured positions in FIG. 9.

The implementation of the drawing-out process involving the ironing process prior to the drawing process could allow the thinner sheet thickness of the flange 11 in the final molded material than the sheet thickness of the base metal sheet (1.8 mm) and the sheet thickness of the circumferential wall of the body (about 1.6 mm). Further, assuming that outer dimensions of both molded materials are the same, the molded material subjected to the drawing-out process involving the ironing process prior to the drawing process (the present invention) had a weight lighter than the molded material subjected to the conventional common drawing method by 10%.

When the drawing-out process involving the ironing is carried out, the region corresponding to the flange 11 of the base metal sheet 2 is stretched. In order to form the molded material subjected to the drawing-out process involving the ironing (the present invention) and the molded material subjected to the conventional common drawing method, both of which have the same dimensions, either a smaller base metal sheet may be used taking into consideration, in advance, an amount of stretching the region corresponding to the flange 11, or an unnecessary portion of the flange 11 may be trimmed.

In such a method for producing the molded material and the molded material produced thereby, the drawing-out process involves an ironing process performed on the region corresponding to the flange 11 of the base metal sheet 2 by pushing the base metal sheet 2 together with the punch 31 into the pushing hole 30*a*, and the subsequent drawing process molds the portion where the sheet thickness has been decreased by the ironing process, while being sandwiched by the die 40 and the drawing sleeve. Therefore, the wrinkles and buckling can be prevented, the sheet thickness of the flange can be prevented from becoming unnecessarily thicker, and the weight of the molded material can be reduced. This configuration is particularly useful for applications in which weight reduction of the molded material and size reduction of the base metal sheet are required, such as motor cases.

Further, the ironing ratio of the ironing process performed during the drawing-out process is equal to or less than 50%, and therefore the generation of seizure and cracking can be avoided.

Furthermore, the width variation portion 31*a* comprised of the inclined surface that continuously changes the width of the punch 31 is provided between the distal end side 310 and the rear end side 311, so that it is possible to avoid the generation of plating residue due to the contact with the width variation portion 31*a* in the ironing process.

Moreover, the width variation portion 31*a* is disposed so as to be in contact with the region corresponding to the lower side shoulder portion Rd formed between the circumferential wall 101 of the body 10 and the flange 11, so that the thickness of the flange 11 can be sufficiently decreased and the target sheet thickness of the body 10 can be more reliably achieved.

Further, when the drawing process is performed on the body, that is, when the flange diameter does not change, a decrease in the sheet thickness of the circumferential wall of the body is suppressed by opening the space between the die 40 and the drawing sleeve 42 so as not to sandwich the material. On the other hand, when the drawing process is performed on the region where the sheet thickness has been decreased by the ironing process in the drawing-out process, the molding is carried out while maintaining the constant mold gap between the die 40 and the drawing sleeve 42, whereby the generation of wrinkles and buckling in the region corresponding to the flange can be avoided.

Further, although the present embodiment illustrates that the three drawing processes are performed, the number of the drawing processes may be changed, as needed, according to the size and required dimensional accuracy of the molded material.

What is claimed is:

1. A method for producing a molded material, the molded material comprising a tubular body and a flange formed at an end portion of the body, the molded material being produced by performing at least two molding processes on a base metal sheet, wherein the at least two molding processes comprise at least one drawing-out process and at least one drawing process performed after the drawing-out process;

wherein the drawing-out process is carried out using a mold that comprises a punch and a die having a pushing hole, the punch having a distal end side initially facing the die and a rear end side at an opposite end of the punch;

wherein a width of the punch on the rear end side is wider than a width of the punch on the distal end side so that when the punch is pushed into the pushing hole of the die, a clearance between the die and the punch is narrower on the rear end side than on the distal end side;

wherein an ironing process is performed on only a region corresponding to the flange of the base metal sheet by pushing the base metal sheet together with the punch into the pushing hole in the drawing-out process;

wherein the drawing process is carried out using a mold comprising a die and a drawing sleeve; and wherein in the drawing process, an ironing process is performed on a region corresponding to the flange of the base material sheet subjected to the ironing process in the drawing-out process, wherein in the ironing process, the die is connected via a mechanism to the drawing sleeve to maintain a constant mold gap between the die and the drawing sleeve.

2. The method for producing the molded material according to claim 1, wherein an ironing ratio of the ironing process performed during the drawing-out process is equal to or less than 50%.

3. The method for producing the molded material according to claim 1, wherein between the distal end side and the rear end side of the punch is provided a width variation portion comprised of an inclined surface that continuously changes a width of the punch.

4. The method for producing the molded material according to claim 3, wherein the width variation portion is disposed so as to be in contact with a region corresponding to a shoulder portion formed between a circumferential wall of the body and the flange.

5. The method for producing the molded material according to claim 1, wherein the mold gap between the die and the drawing sleeve is 1.0 times or more and 1.35 times or less an average thickness of the region corresponding to the flange of the base metal sheet.

6. The method for producing the molded material according to claim 1, wherein the drawing process is carried out while opening the mold gap between the die and the drawing sleeve, when the drawing process is performed on the tubular body of the molded material, and wherein the drawing process is carried out such that the mold gap between the die and the drawing sleeve is 1.0 times or more and 1.35 times or less an average thickness of the flange before the drawing process, when the drawing process is performed on the region corresponding to the flange of the molded material.

7. A method for producing a molded material, the molded material comprising a tubular body and a flange formed at an end portion of the body, the molded material being produced by performing at least two molding processes on a base metal sheet, wherein the at least two molding processes comprise at least one drawing-out process and at least one drawing process performed after the drawing-out process;

wherein the drawing-out process is carried out using a mold that comprises a punch and a die having a pushing hole, the punch having a distal end side initially facing the die and a rear end side at an opposite end of the punch;

wherein a width of the punch on the rear end side is wider than a width of the punch on the distal end side so that when the punch is pushed into the pushing hole of the die, a clearance between the die and the punch is narrower on the rear end side than on the distal end side;

wherein an ironing process is performed on only a region corresponding to the flange of the base metal sheet by pushing the base metal sheet together with the punch into the pushing hole in the drawing-out process;

wherein the drawing process is carried out using a mold comprising a die and a drawing sleeve;

wherein in the drawing process, an ironing process is performed on a region corresponding to the flange of the base material sheet subjected to the ironing process in the drawing-out process, while maintaining a constant mold gap between the die and the drawing sleeve; and wherein the mold gap between the die and the drawing sleeve is 1.0 times or more and 1.35 times or less an average thickness of the region corresponding to the flange of the base metal sheet.

8. A method for producing a molded material, the molded material comprising a tubular body and a flange formed at an end portion of the body, the molded material being produced by performing at least two molding processes on a base metal sheet, wherein the at least two molding processes comprise at least one drawing-out process and at least one drawing process performed after the drawing-out process;

wherein the drawing-out process is carried out using a mold that comprises a punch and a die having a pushing hole, the punch having a distal end side initially facing the die and a rear end side at an opposite end of the punch;

wherein a width of the punch on the rear end side is wider than a width of the punch on the distal end side so that when the punch is pushed into the pushing hole of the die, a clearance between the die and the punch is narrower on the rear end side than on the distal end side;

wherein an ironing process is performed on only a region corresponding to the flange of the base metal sheet by pushing the base metal sheet together with the punch into the pushing hole in the drawing-out process;

wherein the drawing process is carried out using a mold comprising a die and a drawing sleeve;

wherein in the drawing process, an ironing process is performed on a region corresponding to the flange of the base material sheet subjected to the ironing process in the drawing-out process, while maintaining a constant mold gap between the die and the drawing sleeve;

wherein the drawing process is carried out while opening the mold gap between the die and the drawing sleeve, when the drawing process is performed on the tubular body of the molded material, and wherein the drawing process is carried out such that the mold gap between the die and the drawing sleeve is 1.0 times or more and 1.35 times or less an average thickness of the flange before the drawing process, when the drawing process is performed on the region corresponding to the flange of the molded material.

* * * * *